US008667808B2

(12) United States Patent
Kim et al.

(10) Patent No.: US 8,667,808 B2
(45) Date of Patent: Mar. 11, 2014

(54) REFRIGERATOR

(75) Inventors: Dong-Kyu Kim, Changwon-si (KR); Jin-Hyun Kim, Incheon (KR)

(73) Assignee: LG Electronics Inc., Seoul (KR)

( * ) Notice: Subject to any disclaimer, the term of this patent is extended or adjusted under 35 U.S.C. 154(b) by 876 days.

(21) Appl. No.: 12/300,322

(22) PCT Filed: May 30, 2007

(86) PCT No.: PCT/KR2007/002622
§ 371 (c)(1),
(2), (4) Date: Jun. 5, 2009

(87) PCT Pub. No.: WO2007/139347
PCT Pub. Date: Dec. 6, 2007

(65) Prior Publication Data

US 2009/0249820 A1 Oct. 8, 2009

(30) Foreign Application Priority Data

May 30, 2006 (KR) ..... 10-2006-0048746
May 30, 2006 (KR) ..... 10-2006-0048747

(51) Int. Cl.
*F25C 5/18* (2006.01)

(52) U.S. Cl.
USPC ..... 62/344; 62/377

(58) Field of Classification Search
USPC ..... 62/344, 377; 193/2 R, 25 E; 198/338; 222/146.6, 508, 516
See application file for complete search history.

(56) References Cited

U.S. PATENT DOCUMENTS

| | | | | |
|---|---|---|---|---|
| 3,059,450 | A * | 10/1962 | Mueller et al. | 62/344 |
| 3,537,132 | A * | 11/1970 | Alvarez | 62/266 |
| 3,769,809 | A | 11/1973 | Robinson et al. | |
| 4,942,979 | A * | 7/1990 | Linstromberg et al. | 221/75 |
| 5,050,777 | A * | 9/1991 | Buchser | 222/146.6 |
| 5,555,791 | A | 9/1996 | McNeill et al. | |
| 5,860,564 | A | 1/1999 | Jablonski | |
| 6,158,564 | A | 12/2000 | Derelanko | |
| 7,266,951 | B2 * | 9/2007 | Anselmino et al. | 62/66 |
| 7,287,713 | B2 * | 10/2007 | Akuzawa et al. | 241/88.1 |
| 7,418,831 | B2 * | 9/2008 | Bowen et al. | 62/344 |
| 7,469,553 | B2 * | 12/2008 | Wu et al. | 62/344 |
| 2005/0056043 | A1 | 3/2005 | Lee et al. | |
| 2006/0248912 | A1 * | 11/2006 | Park et al. | 62/344 |
| 2007/0251259 | A1 * | 11/2007 | Kim et al. | 62/340 |
| 2008/0127670 | A1 * | 6/2008 | Tikhonov et al. | 62/455 |
| 2008/0156017 | A1 * | 7/2008 | Johnson et al. | 62/320 |

FOREIGN PATENT DOCUMENTS

| | | | |
|---|---|---|---|
| JP | 2000-018784 | A | 1/2000 |
| JP | 3524768 | B2 | 5/2004 |
| JP | 2005-345088 | A | 12/2005 |
| KR | 10-1999-0034649 | A | 5/1999 |
| KR | 10-1999-0080053 | A | 11/1999 |
| KR | 10-0565643 | B1 | 3/2006 |
| KR | 10-0510698 | B1 | 8/2008 |

* cited by examiner

*Primary Examiner* — Mohammad M Ali
(74) *Attorney, Agent, or Firm* — Birch, Stewart, Kolasch & Birch, LLP

(57) ABSTRACT

There is provided a refrigerator. The refrigerator includes an icemaker for making and discharging ice, an ice bank for storing the ice discharged from the icemaker, an ice discharge duct for discharging the ice stored in the ice bank to the dispenser, and an approaching prevention unit that is disposed in the ice discharge duct to prevent a user from approaching the ice bank through the dispenser.

7 Claims, 2 Drawing Sheets

REFRIGERATOR

TECHNICAL FIELD

The present invention relates to a refrigerator having an icemaker.

BACKGROUND ART

Generally, a refrigerator is an electronic appliance that can preserve foodstuffs at a relatively low temperature. The refrigerator supply cool air to a storage chamber using a refrigerant cycle.

An icemaker for making and discharging pieces of ice may be installed in the refrigerator. The icemaker includes an ice crushing device for crushing the ice and supplying the pieces of the ice crushed to a dispenser. The icemaker is connected to the dispenser by an ice discharge duct. The dispenser is generally disposed on a front surface of a door so that a user can easily approach the same.

However, since the refrigerator is designed such that the user can directly approach the icemaker through the ice discharge duct and the dispenser, the child may be injured by the ice crushing device by inserting his/her hand through the ice discharge duct.

Further, since the ice discharge duct is fixed on the door by a structure on which an ice discharge passage is formed, the storage space may be reduced by the structure.

DISCLOSURE OF INVENTION

Technical Problem

In order to solve the above problems, it is an object of the present invention to provide a refrigerator that is designed to prevent a user from directly approaching an icemaker through an ice discharge passage and the dispenser.

Another object of the present invention is to provide a refrigerator that is designed to increase a storage space thereof.

Technical Solution

To achieve these objects and other advantages and in accordance with the purpose of the invention, as embodied and broadly described herein, there is provided a refrigerator including: an icemaker for making and discharging ice; an ice bank for storing the ice discharged from the icemaker; an ice discharge duct for discharging the ice stored in the ice bank to the dispenser; and an approaching prevention unit that is disposed in the ice discharge duct to prevent a user from approaching the ice bank through the dispenser.

In another aspect of the present invention, there is provided a refrigerator including: an icemaker for making and discharging ice; an ice bank for storing the ice discharged from the icemaker; an ice discharge duct for discharging the ice stored in the ice bank to the dispenser; a basket detachably coupled to the ice discharge duct and defining a part of the ice discharge duct; and an approaching prevention unit that is disposed in the ice discharge duct to prevent a user from approaching the ice bank through the dispenser.

The approaching prevention unit may be formed on an ice passage of the basket.

The basket may be provided with a receiving space separated from the ice discharge duct.

The ice discharge duct may be disposed on the door and the door is provided with a seating portion to which the basket is coupled.

Further, the approaching prevention unit may extend in a direction in which the ice is discharged. Further, the approaching prevention unit may extend in a direction in which the basket is mounted and dismounted.

In still another aspect of the present invention, there is provided a refrigerator including: an icemaker for making and discharging ice; an ice bank for storing the ice discharged from the icemaker; an ice discharge duct for discharging the ice stored in the ice bank to the dispenser; and an approaching prevention unit that is rotatably disposed in the ice discharge duct to prevent a user from approaching the ice bank through the dispenser.

The approaching prevention unit may include a rotational center portion coupled to the ice discharge duct and at least two extending portions extending from the rotational center portion in a radial direction.

Each of the extending portions may be provided in the form of a panel.

The approaching prevention portion may rotate by a weight of the ice when the ice is discharged.

Advantageous Effects

According to the present invention, since the user cannot approach the icemaker through the ice discharge passage the injury of the user can be minimized.

Further, the storage space of the refrigerator can be increased.

BEST MODE FOR CARRYING OUT THE INVENTION

Exemplary embodiments of the present invention will be described with reference to the accompanying drawings in detail.

It will be apparent to those skilled in the art that various modifications and variations can be made in the present invention. Thus, it is intended that the present invention covers the modifications and variations of this invention provided they come within the scope of the sprit of the present invention.

Figure 1:
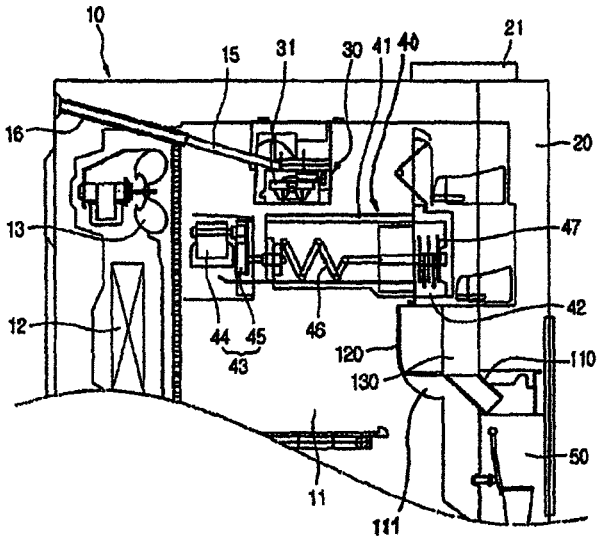
FIG. 1 is a schematic view of a refrigerator according to a first embodiment of the present invention.

FIG. 1 is a schematic view of a refrigerator according to a first embodiment of the present invention.

Referring to FIG. 1, a storage chamber 11 is formed in a main body 10 of a refrigerator. The storage space 11 includes a freezing chamber and a cooling chamber. A fan 13 for directing cool air generated from an evaporator 12 into the storage chamber 11 is disposed in rear of the storage chamber 11.

A door 20 for opening and closing the storage chamber 11 is disposed in front of the storage chamber 11. The door 20 is pivotally installed by a hinge unit 21.

An icemaker 30 for making and discharging ice is installed in the storage chamber 11. The icemaker 30 may be disposed in the storage chamber 11 or the door 20. Particularly, the icemaker 30 may be disposed in the freezing or cooling chamber of the storage chamber 11. When the icemaker 30 is disposed in the cooling chamber, the icemaker 30 should be disposed in an adiabatic case 41 and the cool air of the freezing chamber should be supplied to the adiabatic case 41.

A water supply pipe 15 is connected to the icemaker 30 to supply water to the icemaker 30. At this point, a heater 16 is disposed on the water supply pipe 15. The heater 16 prevents the water supply pipe 15 from being frozen. A heater 16 may be disposed in the icemaker tray 31 to slightly melt a surface of the ice adhered to an icemaker tray 31 when the ice is made in the icemaker tray 31. Further, the icemaker tray 31 rotates by a motor 44 to discharge the ice made in the icemaker tray 31 downward.

An ice bank 40 is disposed under the icemaker 30 to store the ice discharged from the icemaker 30. The ice bank 40 includes a case 41 for storing the ice. In addition, an ice discharge unit 42 is formed on a bottom surface of the case 41.

A motor unit 43 is disposed at a side of the case 41. The motor unit 43 includes the motor 44 and a gear box 45 coupled to the motor 44.

Connected to the motor unit 43 are an ice transfer 46 and an ice crushing device 47. The ice transfer 46 is formed in a spiral shape. The ice crashing device 47 includes a plurality of cutters that rotate to crush the ice.

An ice discharge duct 110 is disposed under the ice bank 40 to discharge the ice stored in the ice bank 40. A dispenser 50 is disposed under the ice discharge duct 110 to allow a user can take the ice. At this point, the ice discharge unit 42 of the ice bank 40 and the dispenser 50 communicate with each other by the ice discharge duct 110. Further, the ice discharge duct 110 is disposed on the door 20.

An approaching prevention unit 130 is disposed in the ice discharge duct 110. The approaching prevention unit 130 disallows a hand of a child to approach the ice bank 40 through the dispenser 50. The approaching prevention unit 130 will be described in detail later.

Figure 2:
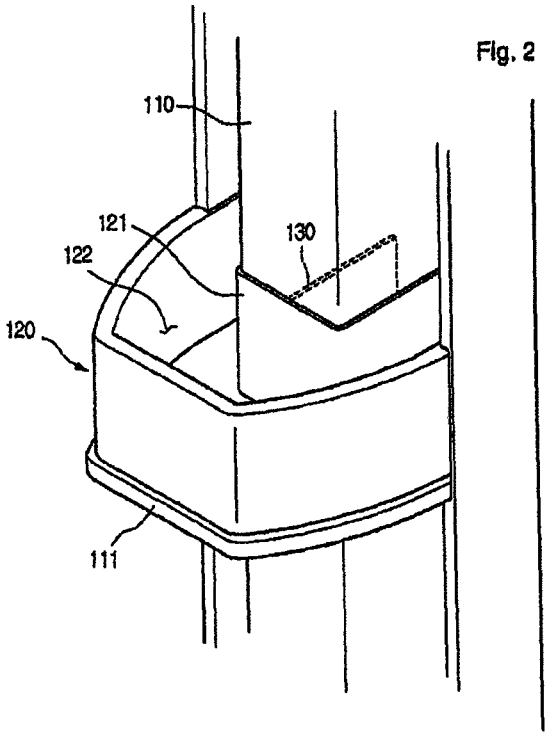
FIG. 2 is a perspective view of an ice discharge duct and a basket that are depicted in FIG. 1.
Figure 3:
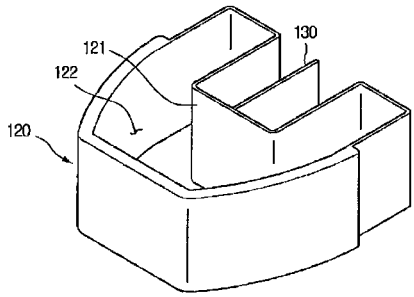
FIG. 3 is a perspective view of the basket depicted in FIG. 2.

FIG. 2 is a perspective view of the ice discharge duct and a basket of the refrigerator, and FIG. 3 is a perspective view of the basket.

Referring to FIGS. 2 and 3, a basket 120 is detachably coupled to the ice discharge duct 110. Therefore, the user can take out the basket 120 in a state where the door is opened.

An ice passage 121 defining a part of the ice discharge duct 110 is formed in the basket 120. When the basket 120 is coupled to the ice discharge duct 110, the ice passage 121 communicates with the ice discharge duct 110. Further, a food receiving space 122 may be formed on the basket 120 and separated from the ice discharge duct 110. Since the basket 120 forms a part of the ice discharge duct 110 as well as the food receiving space 122, the storage space of the refrigerator is substantially enlarged.

A seating portion 111 on which the basket 120 is coupled is formed on the door 20. The seating portion 111 is formed in a panel type supporting a bottom of the basket 120. The seating portion 111 may be integrally formed with the ice discharge duct 110 or the door 20.

The approaching prevention unit 130 may be integrally formed with the ice passage 121 of the basket 120 or an inner surface of the ice discharge duct 110. At this point, the approaching prevention unit 130 may be disposed in a direction in which the basket 120 is mounted or dismounted. Further, the approaching prevention unit 130 may be formed in a panel type or a band type disposed in a direction in which the ice is discharged. The approaching prevention unit 130 divides the ice passage to have a size that allows the ice to pass therethrough while disallowing the hand of the user to pass therethrough.

The following will describe an operation of the refrigerator structured as described above.

Water is supplied to the icemaker 30 through a water supply hose. The water supplied to the icemaker 30 is frozen to be ice by cool air. The ice is discharged to the case 41 of the ice bank 40. Through this process, a predetermined amount of the ice is stored in the case 41 of the ice bank 40.

Meanwhile, when the user pushes an ice dispensing button, the motor unit 43 of the ice bank 40 is driven, by which the ice transfer 46 and the ice crushing device 47 operate. At this point, the ice in the case 41 is transferred to the ice crushing device 47 by the ice transfer 46 and crushed by the ice crushing device 47.

Pieces of the ice crushed in the ice crushing deice 47 are discharged to the dispenser through the ice discharge duct 110. Therefore, the user can use the pieces of the ice dispensed from the dispenser 50.

Meanwhile, when the child inserts his/her hand into the ice discharge duct through the dispenser 50 with curiosity, the hand cannot further inserted by the approaching prevention unit 130. Therefore, the injury of the hand by the ice crushing device 47 can be prevented.

The following will describe a refrigerator according to a second embodiment of the present invention.

A refrigerator of this second embodiment is identical to that of the first embodiment except for structures of the ice discharge duct and the approaching prevention unit. In the first and second embodiments, same reference numbers will be used throughout the drawings to refer to the same or like parts.

Figure 4:
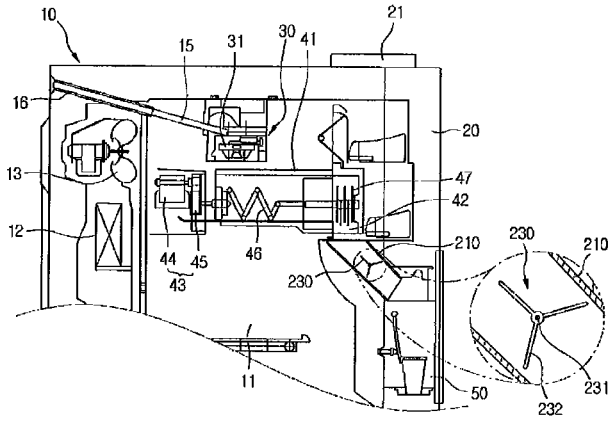
FIG. 4 is a schematic view of a refrigerator according to a second embodiment of the present invention.

FIG. 4 is a schematic view of a refrigerator according to a second embodiment of the present invention.

Referring to FIG. 4, the refrigerator has an ice discharge duct 210 that is disposed under an ice bank 40 to dispense ice from the ice discharge duct 210. A dispenser 50 for dispensing the ice to an external side is disposed under the ice discharge duct 210. At this point, the dispenser 50 and the ice bank 40 communicate with each other by the ice discharge duct 210. Further, the ice discharge duct 210 is disposed on a door 20.

Disposed in the ice discharge duct 210 is an approaching prevention unit 230. The approaching prevention unit disallows a hand of a child to approach his/her hand to the ice bank 40 through the dispenser 50.

Figure 5:
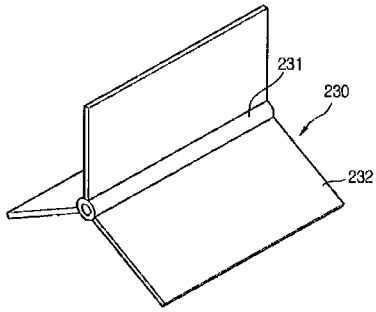
FIG. 5 is a perspective view of an approaching prevention unit depicted in FIG. 4.

FIG. 5 is a perspective view of the approaching prevention unit disposed on the ice discharge duct of the refrigerator of the present invention.

Referring to FIG. 5, the approaching prevention unit 230 includes a rotational center portion 231 coupled to the ice discharge duct 210 and at least two extending portions 232 extending in a radial direction from the rotational center portion 231. At this point, the rotational center 231 is formed in a rod type disposed crossing an inner portion of the ice discharge duct 210. The extending portions 232 may be provided in the form of a thin, long rode. However, the present invention is not limited to this configuration.

At this point, the extending portion 232 is spaced apart from the rotational center portion 231 by about 120° and thus the passage of the ice discharge duct can be almost closed regardless of the rotational angle of the approaching prevention unit 230.

In this embodiment, although three extending portions 232 are formed extending from the rotational center portion 231, the present invention is not limited to this configuration. The number of the extending portions may vary.

An operation of the refrigerator of this second embodiment will be described hereinafter.

When the user pushes an ice dispensing button, the motor unit 43 of the ice bank 40 is driven, by which the ice transfer 46 and the ice crushing device 47 operate, At this point, the ice in the case 41 is transferred to the ice crushing device 47 by the ice transfer 46 and crushed by the ice crushing device 47.

Pieces of the ice crushed in the ice crushing deice 47 are discharged to the dispenser through the ice discharge duct 210. The approaching prevention unit 230 is pressed by the ice discharged and rotates to allow the ice to pass therethrough. The ice passing through the approaching prevention unit 230 is discharged to the dispenser 50.

When the ice is not being discharged, the approaching prevention unit 230 blocks the ice discharge duct 210 and thus the leakage of the cool air in the storage chamber 11 can be minimized.

Meanwhile, when the child inserts his/her hand into the ice discharge duct through the dispenser 50 with curiosity, the hand cannot further inserted by the approaching prevention unit 230. Therefore, the injury of the hand by the ice crushing device 47 can be prevented.

INDUSTRIAL APPLICABILITY

According to the refrigerator of the present invention, the injury of the user can be prevented and the storage space can be enlarged. Therefore, the industrial applicability of the present invention is very high.

The invention claimed is:

1. A refrigerator comprising:

an icemaker for making and discharging ice;

an ice bank for storing the ice discharged from the icemaker;

an ice discharge duct for discharging the ice stored in the ice bank to a dispenser, wherein the ice discharge duct is disposed on a door of the refrigerator; and an approaching prevention unit that is disposed in the ice discharge duct to prevent a user's hand from being inserted into the ice bank through the dispenser, wherein the approaching prevention unit is configured to be removable from and insertable into the ice discharge duct, wherein the approaching prevention unit divides an inner space of the ice discharge duct into a plurality of ice passages, and wherein the ice stored in the ice bank is discharged through one of the plurality of ice passages.

2. The refrigerator according to claim 1, wherein the approaching prevention unit is disposed crossing an inner passage of the ice discharge duct.

3. The refrigerator according to claim 1, wherein the approaching prevention unit is detachably coupled to the ice discharge duct.

4. The refrigerator according to claim 1, wherein the approaching prevention unit is disposed in a direction in which the ice is discharged.

5. A refrigerator comprising:

an icemaker for making and discharging ice;

an ice bank for storing the ice discharged from the icemaker;

an ice discharge duct for discharging the ice stored in the ice bank to a dispenser, wherein the ice discharge duct is disposed on a door of the refrigerator having the dispenser; and an approaching prevention unit that is rotatable disposed in the ice discharge duct to prevent a user's hand from being inserted into the ice bank through the dispenser, wherein the approaching prevention unit includes a rotational center portion coupled to the ice discharge duct and at least two extending portions extending from the rotational center portion in a radial direction, and wherein extending direction of the rotational center portion crosses a discharging direction of ice in the discharging duct.

6. The refrigerator according to claim 5, wherein each of the extending portions is provided in the form of a panel.

7. The refrigerator according to claim 5, wherein the approaching prevention unit rotates by a weight of the ice when the ice is discharged.

* * * * *